United States Patent [19]

Huelsekopf

[11] 4,034,510

[45] July 12, 1977

[54] WINDOW CONSTRUCTION

[75] Inventor: Alfred George Huelsekopf, Newmarket, Canada

[73] Assignee: Com-Dor Supply Limited, Downsview, Canada

[21] Appl. No.: 737,614

[22] Filed: Nov. 1, 1976

[51] Int. Cl.[2] ..... E05D 13/00

[52] U.S. Cl. ..... 49/419; 49/432; 49/434; 49/454

[58] Field of Search ..... 49/454, 453, 455, 428, 49/414, 417, 418, 419, 420, 423, 434, 435, 436, 442, 431, 432

[56] References Cited

U.S. PATENT DOCUMENTS 3,375,611 4/1968 Osten, Sr. ..... 49/455

3,377,747 4/1968 Donkin ..... 49/414

FOREIGN PATENT DOCUMENTS 872,571 6/1971 Canada ..... 49/453

*Primary Examiner*—Philip C. Kannan

*Attorney, Agent, or Firm*—Fetherstonhaugh & Co.

[57] ABSTRACT

A window assembly in which two window units are slidably mounted and in which one of the window units cannot be removed until the other has been removed. The removal of a first of the window units releases the sash locking member for lateral movement within the frame to permit overlapping lips of the other window unit and its associated frame to move out of overlapping engagement with one another.

9 Claims, 7 Drawing Figures

WINDOW CONSTRUCTION

This invention relates to window assemblies. In particular this invention relates to a window assembly in which two window sashes are located in a frame member and in which one of the window sashes can not be removed until the other has been removed.

While it is important to construct window assemblies such that both of the window units which are located in the window frame may be removed for cleaning or servicing, it is also important to ensure that the removal can not be effected with ease in order to prevent unlawful entry and to ensure that the windows will not fall out under the influence of a light load.

In prior Canadian patent application Ser. No. 236,930, I have described and illustrated a frame member which includes a component which acts as a sash locking component. This component is proportioned so as to fit in a close fitting relationship within the channel formed in the frame member which supports it so that little or no lateral movement between this component and its frame member is permitted. A similar structure is illustrated in Canadian Pat. No. 872,571, dated June 8, 1971. In these prior devices the window sashes are permanently mounted in the frame and locked therein by means of the sash locking component.

The construction of the present invention provides all of the rigidity which can be obtained from the construction of the prior frame members while permitting the window units to be readily removed for cleaning or servicing.

SUMMARY

According to one aspect of the present invention there is provided a window assembly including; a plurality of frame members which provide a header, a sill and a pair of jambs, a first window unit and a second window unit each having a sash releasably mounted in said frame members, at least one of said frame members having a channel extending longitudinally thereof, a first flange and a second flange on said frame member, said first and second flanges projecting from opposite sides of said channel towards one another and having first and second inner edges respectively, said first and second edges being spaced from one another to provide a passage opening into said channel, said first sash having a lip projecting laterally therefrom to overlap said first flange such that said first sash cannot be removed directly outwardly from said channel when said lip overlaps said flange, the improvement of a sash locking member mounted within and extending longitudinally of said channel, said sash locking member having a width which is less than the width of said channel by an amount of at least equal to the overlapping extent of said lip and flange and which is greater than the width of said passage so as to be laterally movable within said channel and retained within said channel by said first and second flanges, said sash locking member being resiliently urged towards said passage, said sash locking member being adapted to engage said first and second sashes when said first and second sashes are located in said passage to prevent lateral movement of said first and second sashes with respect to said sash locking member and lateral movement of said first sash with respect to said second sash, said first and second sashes engaging said frame to prevent movement of said sash locking member with respect to said frame whereby said lip cannot be moved out of said overlapping relationship with said flange when said second sash is located in said passage, said second sash being directly removable from said passage to release said sash locking member for lateral movement with respect to said frame to permit movement of said first sash to a position in which said lip is free to pass outwardly from said channel through said passage.

The invention will be more clearly understood after reference to the following detailed specification read in conjunction with the drawings wherein, FIG. 1 is a pictorial view of a door incorporating a window assembly according to an embodiment of the present invention;

Figure 1:
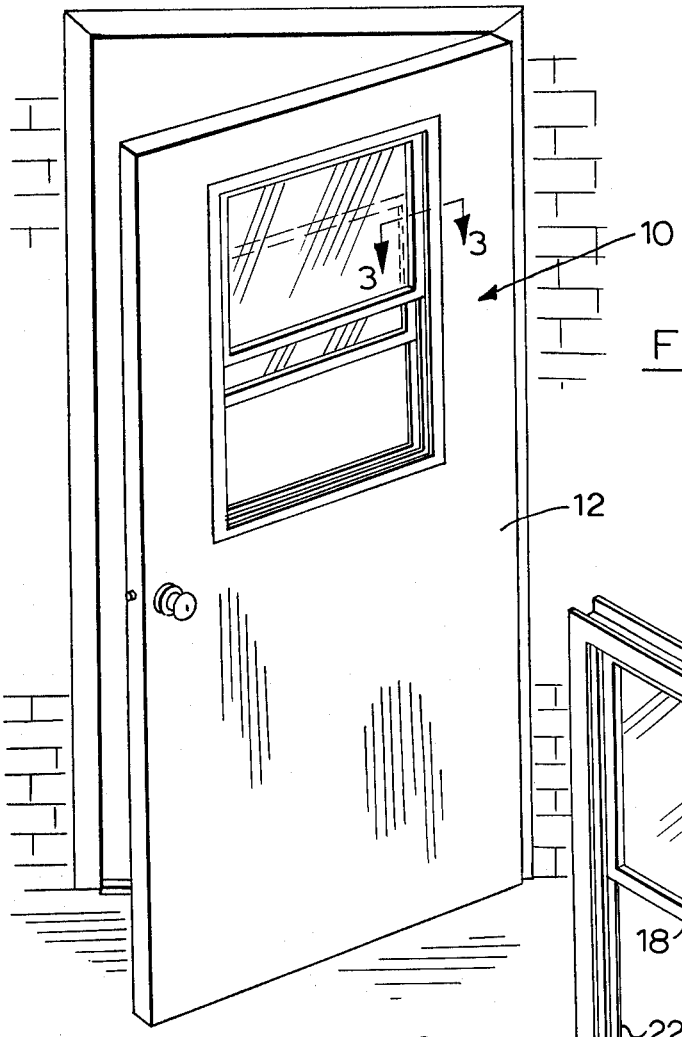
Figure 2:
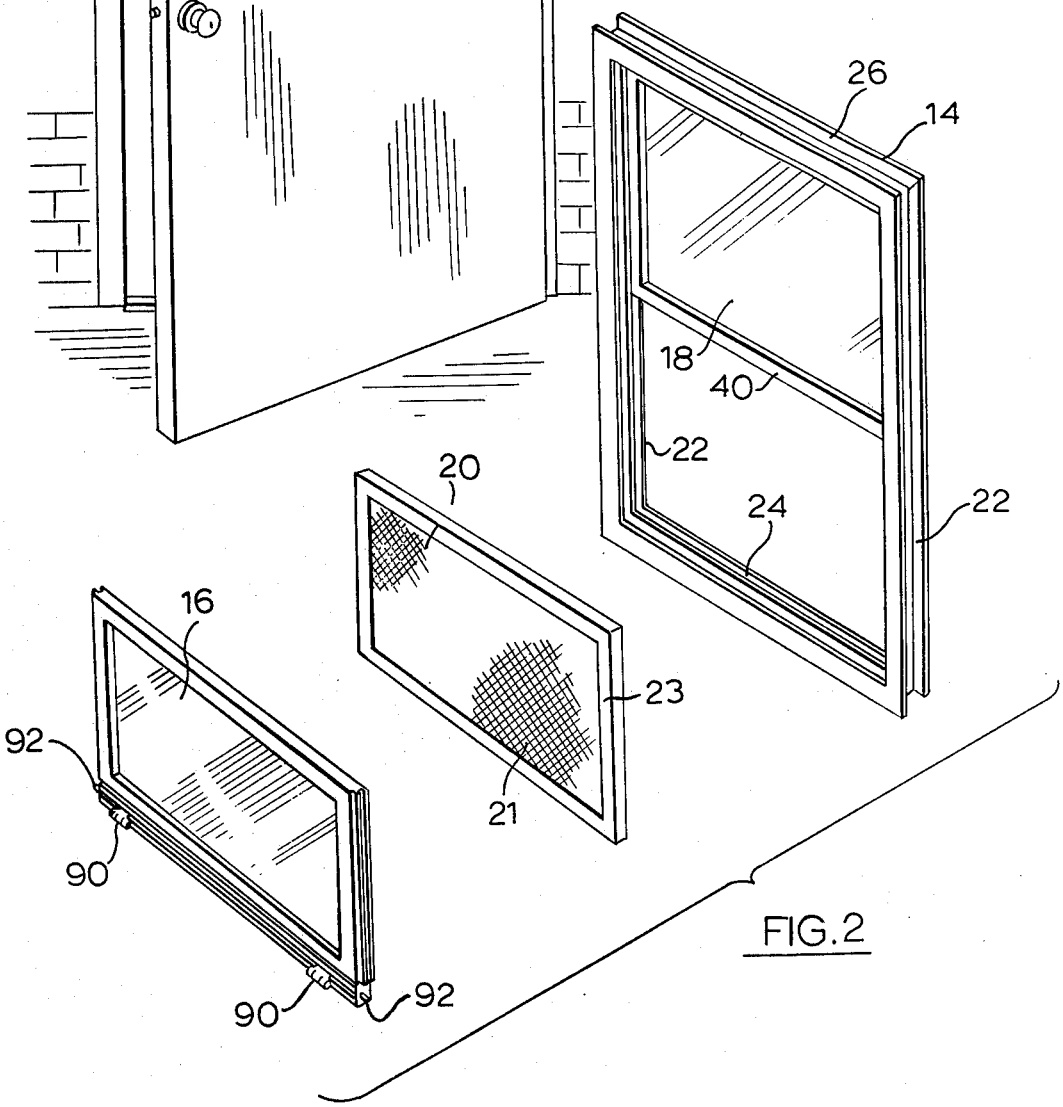
FIG. 2 is an exploded view of a window unit according to an embodiment of the present invention.

With reference to the drawings, the reference numeral 10 refers generally to a window assembly according to an embodiment of the present invention. The window assembly 10 is adapted to be fitted within the window opening of a door 12 or the like. As shown in FIG. 2 of the drawings, the assembly consists of a window frame 14, an inner window unit 16, an outer window unit 18, and a screen unit 20. The frame 14 consists of a pair of oppositely disposed jamb members 22 and a pair of oppositely disposed end rails 24, 26 of which the lower rail 24 is a sill member and the upper rail 26 is a header. The components of the frame are preferably made from extruded plastic material such as a rigid vinyl which is sufficiently flexible to permit resilient bending of the components.

Figure 3:
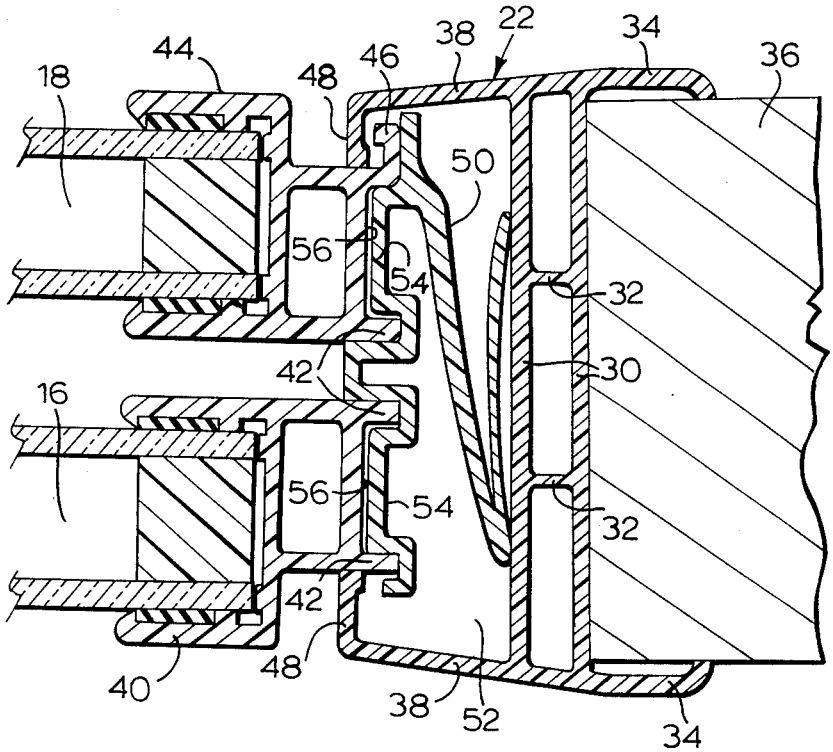
FIG. 3 is a sectional view along the line 3—3 of FIG. 1.

As previously indicated, FIG. 3 of the drawings is a section through a jamb member 22. The jamb member 22 differs from the frame members which are presently in common use in that its transverse wall consists of two panels 30 which are spaced from one another by ribs 32. This structure provides a transverse wall which is more rigid than the single thickness transverse walls which have previously been employed. By rigidifying the transverse wall, I have substantially removed the flexibility of this wall so that if it is necessary to move the arms 34 away from one another to accomodate a wall 36, the deflection of the arms 34 will take place outwardly of the transverse wall 30 and will not result in a corresponding inward deflection of the arm portions 38. The flexibility of the transverse wall 30 of the frame members which have previously been employed has caused the arm portions which support the window frames to be deflected inwardly on occasion, with the result that the arms bear against the sash and restrict the movement of the sash within the frame, thus making the opening and closing of the window more difficult.

As shown in FIG. 3 of the drawings, the sash 40 of the inner window unit 16 has a pair of lugs 42 projecting upwardly therefrom. The sash 44 of the outer window 18 differs from the sash 40 of the inner window in that the outer lug 42 thereof has a lip portion 46 projecting laterally therefrom such that when the sash 44 is in the position shown in FIG. 3, the lip 46 overlaps the flange 48 and prevents removal of the sash 44 from the jamb. The outer window unit 18 is locked in this position by means of the sash locking member 50 which extends longitudinally of the jamb over the full length of the jamb. The sash locking member 50 has a width which is less than the width of the channel 52 formed between the arms 38 by an amount which is at least equal to the overlapping extent of the lip 46 and the flange 48. The bottom wall of the sash locking member 50 has ridges 54 which are adapted to project into the recesses 56 formed between the projections 42 to engage the sash members to prevent lateral movement of the sashes with respect to one another. The sashes 40 and 44 also engage the inner edges of the flanges 48 to prevent lateral movement of the sash locking member 50 with respect to the jamb member whereby the lip 46 cannot be moved out of its overlapping relationship with respect to the flange 48 when the inner sash 40 is located in the jamb in engagement with the locking member 54 as shown in FIG. 3.

Figure 4:
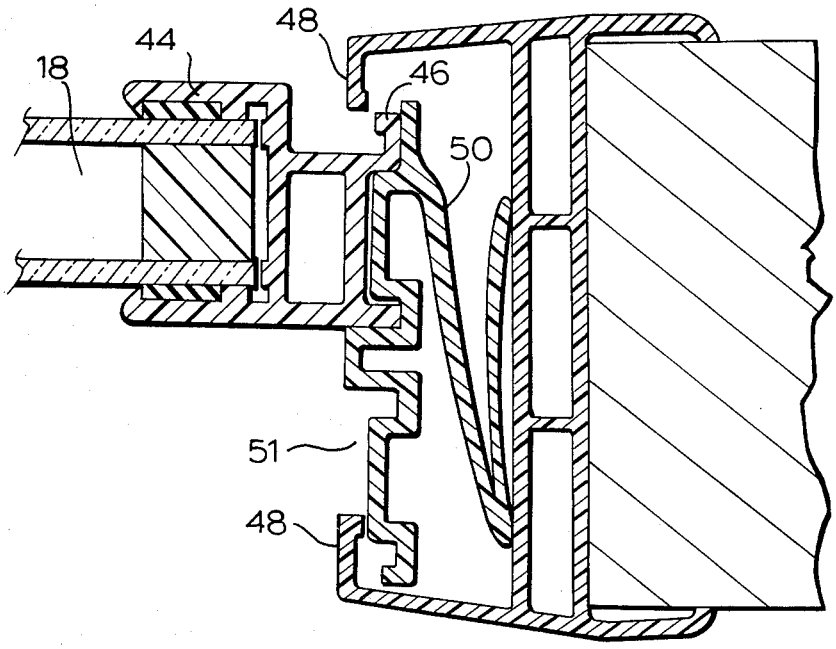
FIG. 4 is a view similar to FIG. 3 with the inner window unit removed.

In order to remove the window units from the jamb member, the inner window unit 16 is removed by initially moving it inwardly of the jamb to compress the sash locking member towards the transverse wall 30 to permit removal of the opposite sash from its associated jamb and thereafter withdrawing the window unit 16 directly from the frame. It will be understood that in most instances it is necessary to at least partially open the window to release the interlocking structure described in copending application Ser. No. 236,930. When the inner window unit has been removed, the sash locking member 50 is free to move laterally within the chamber 50 formed in the jamb member to the position shown in FIG. 4 of the drawings wherein the lip 46 is moved inwardly of the flange 48 which it previously overlapped. When the sash 44 is in this position, the window unit 18 can be removed in a conventional manner. It will be noted that the width of the sash locking member 50 is such that it will be retained within the passage 51 formed between the inner ends of the flanges 48 after the removal of the outer window unit 18.

From the foregoing it will be apparent that as long as the inner window unit 16 is located in the jamb in engagement with the sash locking member 50, it is not possible to remove the outer window unit. As soon as the inner window unit is removed, removal of the outer window unit becomes a very simple process.

It will be apparent that the initial mounting of the window unit in the frame is carried out in the reverse order to that described for the removal of the window unit. The outer window unit 18 is located in the position shown in FIG. 4 of the drawings in engagement with the sash locking member. The window unit 18 is then moved to the position wherein the lip 46 overlaps the flange 48. This moves the sash locking member 50 to a position to receive the inner window unit sash 40. The inner window unit 16 is then located with the sash 40 engaging the sash locking member 50, thereby locking the outer window unit within the jamb as previously described.

Figure 5:
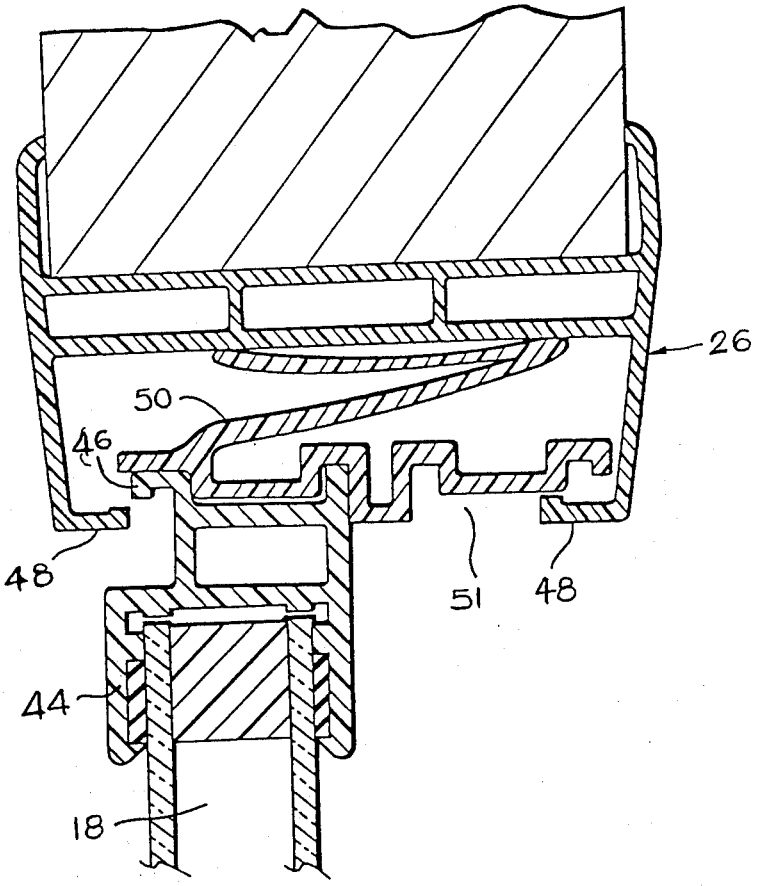
FIG. 5 is a view similar to FIG. 3 in which the window unit opens vertically.

Various modifications of the present invention will be apparent to those skilled in the art without departing from the scope of the invention. For example, it will be apparent that while reference has been made to the frame member in which the sash locking member is mounted as being a jamb member, the frame member could be a header member in an application wherein the windows slide horizontally. As illustrated in FIG. 5, the structure in this instance is the same as that illustrated in FIG. 4, rotated through 90°, in which the outer window unit 18 is suspended by its sash from the upper rail 26. Although the inner window unit 16 does not engage the sash locking member 50, movement of the sash locking member 50 is prevented by reason of the fact that the location of the inner window unit in the position shown in FIG. 3 in engagement with the jamb prevents movement of the outer window unit 18 as previously described. If it is not possible to move the outer window 18 with respect to its associated jamb, it is not possible to move the outer window unit with respect to its associated header.

It will also be apparent that while the frame members and sash members have previously been described as being fabricated from extruded plastic material, these members may be made from any of the conventional materials from which window units are formed including extruded and roll formed metal such as aluminum, steel or the like, or they may be made from wood.

Figure 6:
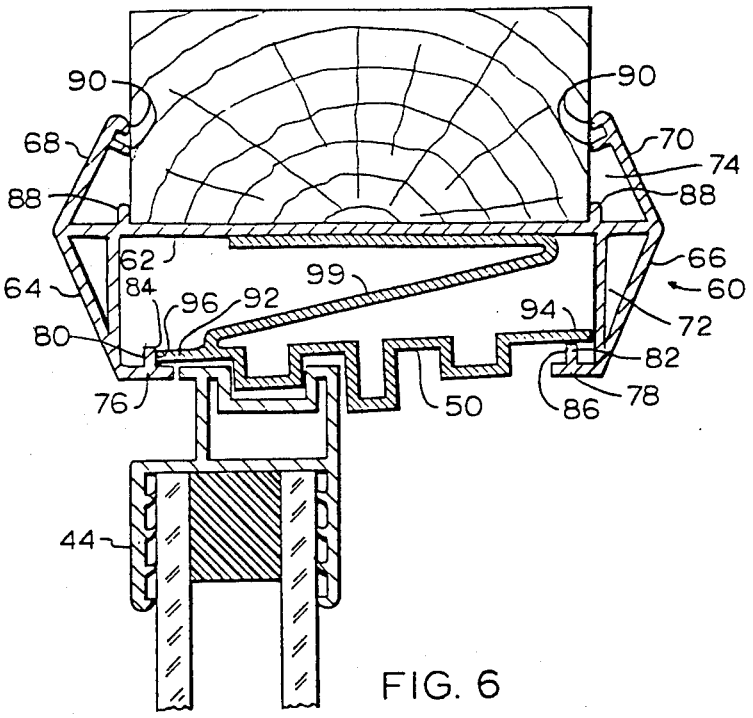
FIG. 6 is a sectional view through a frame member according to further embodiment of the present invention showing a first step in the location of a sach in the frame.
Figure 7:
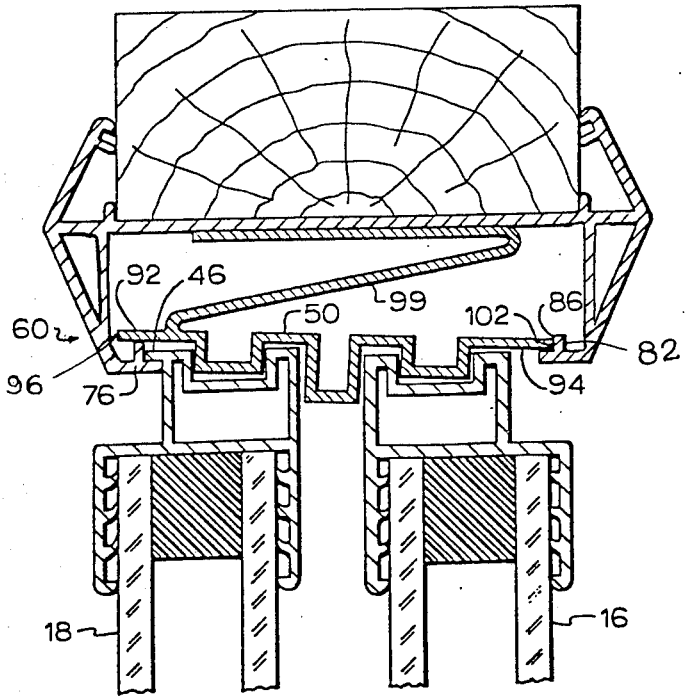
FIG. 7 is a view similar to FIG. 6 showing a further step in the location of the sash.

A frame member according to a further embodiment of the present invention is illustrated in FIGS. 6 and 7 of the drawings. In this embodiment, the frame member is identified generally by the reference numeral 60. The frame member includes a single thickness divider web 62, first inner side wall 64, second inner side wall 66, first outer side wall 68 and second outer side wall 70. The first inner side walls 64 and 66 cooperate with one another and the divider web 62 to define a channel 72 and the outer side walls 68 and 70 cooperate with the divider web 62 to form a second channel 74. The side wall 64 has a flange 76 projecting inwardly from the upper edge thereof and the side wall 66 has a flange 78 projecting inwardly from the upper edge thereof. A first tongue 80 projects downwardly from the flange 76 into the channel 72 and a second tongue 82 projects downwardly from the flange 78 into the channel 72. The first and second tongues 80 and 82 have first and second locking faces 84 and 86 respectively.

A pair of ridges 88 project outwardly from the outer face of the divider web 62 and sealing ridges 90 extend along the inner face of the side walls 68 and 70.

The sash locking member 50 has a first marginal edge portion 92 at one edge thereof and a second marginal edge portion 94 at the other edge thereof. The first marginal edge portion 92 underlies the first flange 76 and the second marginal edge portion 94 underlies the second flange 78. As in the previous embodiments described above, the overall width of the sash locking member is greater than the distance between the inner edges of the flanges 76 and 78 and it is greater than the distance between the locking faces 84 and 86 of the first and second tongues 80 and 82.

In use, the locking flange is located in the position shown in FIG. 6 of the drawings prior to the location of a sash 44 in an operative position. In this position the first edge 96 of the locking member 50 is located in a position abutting the first locking face 84 and the second marginal edge portion 94 bears against the inner edge of the tongue 86. The spring member 99 of the sash locking member urges the sash locking member to the position spaced from the divider wall 62 shown in FIG. 6 of the drawings. It will be noted that the width of the first marginal edge portion 92 is such that it projects outwardly from the inner edge of the flange 76 a distance sufficient to enable the sash 44 to be located in an operative position resting on the sash locking member. To complete the mounting of the sash member, the sash locking spring 99 is compressed to permit the lip portion 46 of the sash 44 to drop below the flange 76. Thereafter the sash locking member 50 is moved laterally towards the first side wall to locate the lip portion 46 of the sash in a position underlying the first flange 76. In this position, the second side edge 105 of the second marginal edge portion 94 is located in an abutting relationship with respect to the locking face 86 of the tongue 82. As previously indicated, when the sash locking member is located in this position, lateral movement is prevented at one side by the engagement of the second edge 102 with the locking face 86 and at the other side by the interlocking relationship between the sash member 44, frame member 60 and sash locking member 50. In this embodiment the sash locking member 50 is locked to prevent removal of the outer window 18 even when the inner window 16 is not in a position engaging the sash locking member. As shown in FIG. 7 of the drawings, the inner window 16 may fit freely on the sash locking member when the sash locking member is in the position shown.

From the foregoing, it will be apparent that the present invention provides a simple and inexpensive structure which permits one of two window units of a sash to be locked in the sash when the other window unit is located in the sash so that the window units cannot be removed from one side of the window frame.

What I claim as my invention is:

1. In a window assembly including; a plurality of frame members which provide, a header, a sill and a pair of jambs; a first window unit and a second window unit, each having a sash releasably mounted in said frame members, at least one of said frame members having, a channel extending longitudinally thereof, a first flange and a second flange on said frame member, said first and second flanges projecting from opposite sides of said channel towards one another and having first and second inner edges respectively, said first and second edges being spaced from one another to provide a passage opening into said channel, said first sash having a lip projecting laterally therefrom to overlap said first flange such that said first sash cannot be removed directly outwardly from said channel when said lip overlaps said flange, the improvement of: a sash locking member mounted within and extending longitudinally of said channel, said sash locking member having a width which is less than the width of said channel by an amount at least equal to the overlapping extent of said lip and flange and which is greater than the width of said passage so as to be laterally movable within said channel and retained within said channel by said first and second flanges, said sash locking member being resiliently urged towards said passage, said sash locking member being adapted to engage said first and second sashes when said first and second sashes are located in said passage to prevent lateral movement of said first and second sashes with respect to said sash locking member and lateral movement of said first sash with respect to said second sash, said first and second sashes engaging said frame to prevent movement of said sash locking member with respect to said frame whereby said lip cannot be moved out of said overlapping relationship with said flange when said second sash is located in said passage, said second sash being directly removable from said passage to release said sash locking member for lateral movement with respect to said frame to permit movement of said first sash to a position in which said lip is free to pass outwardly from said channel through said passage.

2. A window assembly as claimed in claim 1 wherein said overlapping first flange and lip of said frame member and said first sash member respectively are each formed with lugs which are directed towards one another and which interlock to prevent lateral movement of said first sash member with respect to said frame until said first sash member is spaced inwardly of said channel.

3. A window assembly comprising a. a plurality of frame members which provide, a header, a sill and a pair of jambs, b. first and second window units each having a sash releasably mounted in said frame members, c. at least one of said frame members having a channel extending longitudinally thereof, first and second flanges on said frame member projecting from opposite sides of said channel towards one another and having inner edges spaced from one another to provide a passage opening into said channel, d. said first sash having a lip projecting laterally therefrom to overlap said first flange such that said first sash cannot be removed directly outwardly from said channel when said lip overlaps said first flange, e. a sash locking member mounted within and extending longitudinally of said channel, said sash locking member having a width which is less than the width of said channel by an amount at least equal to the overlapping extent of the lip and first flange and which is greater than the width of said passage so as to be laterally movable within said channel and retained within said channel by said flanges, said sash locking member being resiliently urged towards said passage, f. said sash locking member being adapted to engage said first and second sashes when said first and second sashes are located in said passage to prevent lateral movement of said first and second sashes with respect to said sash locking member and lateral movement of said first sash with respect to said second sash, said first and second sashes engaging said frame to prevent movement of said sash locking member with respect to said frame whereby said lip cannot be moved out of said overlapping relationship with said first flange when said second sash is located in said passage, said second sash being directly removable from said passage to release said locking member for lateral movement with respect to said frame to permit movement of said first sash to a position in which said lip is free to pass outwardly from said channel through said passage.

4. A window assembly as claimed in claim 3 wherein said frame member comprises a pair of transversely extending longitudinally elongated webs arranged in a spaced parallel relationship and having rib members extending therebetween for maintaining said webs in said spaced relationship, a first pair of side walls projecting outwardly from opposite sides of one of side transversely extending webs for securing said frame member to a supporting structure and a second pair of side walls projecting outwardly from said outer transversely extending web member to form said channel, said first pair of side walls being resiliently deflectable with respect to said first transversely extending web member without effecting the spacing of said second pair of side walls.

5. In a window assembly including; a plurality of frame members which provide, a header, a sill and a pair of jambs; a first unit having a sash releasably mounted in said frame members, at least one of said frame members having; a channel extending longitudinally thereof, first and second flanges on said frame member projecting from opposite sides of said channel towards one another and having first and second inner edges respectively, said first and second edges being spaced from one another to provide a passage opening into said channel, said first sash having a lip projecting laterally therefrom to underly said first flange such that said first sash cannot be removed directly outwardly from said channel when said lip underlies said flange, the improvement of:

a sash locking member mounted within and extending longitudinally of said channel, said sash locking member having a width which is less than the width of said channel by an amount at least equal to the underlying extent of said lip and flange and which is greater than the width of said passage so as to be laterally movable within said channel and retained within said channel by said first and second flanges, said sash locking member being resiliently urged towards said passage, said sash locking member being adapted to engage said first sash when said first sash is located in said passage with its lip underlying said first flange to prevent lateral movement of said first sash with respect to said sash locking member, said sash locking member being adapted to engage said second flange to prevent movement of said sash locking member with respect to said frame whereby said lip cannot be moved out of said underlying relationship with said first flange until said sash locking member is moved inwardly of said channel to disengage said second flange.

6. A window assembly as claimed in claim 5 including a first tongue projecting downwardly from a first of said flanges and a second tongue projecting downwardly from a second of said flanges, said first and second tongues having first and second locking faces spaced inwardly from the adjacent inner edges of said first and second flanges respectively, said locking faces being disposed opposite one another on opposite sides of said channel, said locking member having a width which is greater than the distance between said locking faces whereby only one edge of said locking member at a time may be located in an abutting relationship with respect to a locking face.

7. A window assembly as claimed in claim 6 wherein said sash locking member has a first edge and a second edge at opposite sides thereof, a first marginal edge portion extending inwardly from said first edge and a second marginal edge portion extending inwardly from said second edge, said first marginal edge portion being disposed to underlie said lip portion of said first sash in use and having a width which is greater than the width of said lip portion so as to permit said first sash to be located on said sash locking member when said first edge of said sash locking member is located in an abutting relationship with respect to said first locking face to facilitate the mounting of said first sash.

8. A window assembly as claimed in claim 6 wherein said second edge of said sash locking member engages said second locking face of said second tongue when said locking member is positioned to locate said lip of said first sash member in a position underlying said first flange of said frame member whereby said second tongue locks said sash locking member against lateral movement required to release said first sash member.

9. In a window frame assembly for supporting a window unit having a first sash member thereon, said frame assembly including a plurality of frame members which provide, a header, a sill and a pair of jambs, at least one of said frame members having a channel extending longitudinally thereof, first and second flanges on said frame member projecting from opposite sides of said channel towards one another and having first and second inner edges respectively, said first and second edges being spaced from one another to provide a passage opening into said channel, said first sash having a lip projecting laterally therefrom arranged to underly said first flange such that said first sash cannot be removed directly outwardly from said channel when said first sash is in a first locking position in which said lip underlies said flange, the improvement of:

a sash locking member mounted within and extending longitudinally of said channel, said sash locking member having a width which is less than the width of said channel by an amount at least equal to the underlying extent of said lip and flange and which is greater than the width of said passage so as to be laterally movable within said channel and retained within said channel by said first and second flanges, said sash locking member being resiliently urged towards said passage, said sash locking member being adapted to engage said first sash when said first sash is located in said passage with its lip underlying said first flange to prevent lateral movement of said first sash with respect to said sash locking member, said locking member also being adapted to be locked with respect to said one frame member against lateral movement away from said first locking position when it is located in said first position.

* * * * *